US005390630A

United States Patent [19]

Virr

[11] Patent Number: 5,390,630

[45] Date of Patent: Feb. 21, 1995

[54] STATIONARY FEED ARRANGEMENT FOR USE IN A ROTARY FLUID BED GASIFIER

[75] Inventor: Michael J. Virr, Fairfield, Conn.

[73] Assignee: Spinheat Ltd., Fairfield, Conn.

[21] Appl. No.: 257,156

[22] Filed: Jun. 9, 1994

[51] Int. Cl.[6] ..... F22B 1/00

[52] U.S. Cl. ..... 122/4 D; 110/226; 110/229; 110/245; 110/246

[58] Field of Search ..... 110/245, 226, 229, 246; 122/4 D

[56] References Cited

U.S. PATENT DOCUMENTS 5,070,821 12/1991 Virr ..... 122/7 K
5,301,619 4/1994 Keershaekers ..... 110/246
5,307,765 5/1994 Virr ..... 122/4 D

*Primary Examiner*—Edward G. Favors
*Attorney, Agent, or Firm*—Ohlandt, Greeley & Ruggiero

[57] ABSTRACT

A rotary fluid bed gasifier having a combustor assembly and a stationary feed conduit which is capable of feeding a carbonaceous material and/or limestone from outside of the gasifier and delivering this material to the gasification chamber of the combustor assembly through a rotating wall of the combustor assembly, wherein the stationary conduit is centrally disposed within the combustor assembly such that the rotatable inner assembly of the combustor assembly revolves about the stationary conduit.

27 Claims, 4 Drawing Sheets

STATIONARY FEED ARRANGEMENT FOR USE IN A ROTARY FLUID BED GASIFIER

The present invention relates to a novel rotary fluid bed gasifier which is affixed to either the boiler of a power station wherein coal is gasified and combusted efficiently to produce steam, a heat treatment furnace, or a gas turbine which is capable of providing reduced $SO_x$ and $NO_x$ emissions. In particular, it relates to a means for feeding coal and limestone into the rotating bed of the gasifier through the rotating section or backplate of the combustor assembly.

BACKGROUND OF THE INVENTION

Due to the high cost of oil and the inherent dangers associated with nuclear energy, engineers and scientists are again turning to coal as an inexpensive and readily available source of energy. Coal is burned to generate heat which is captured as steam in packaged boilers. The steam is either used to power a turbine which turns a generator and produces electricity or used in industrial process applications. Unfortunately, the burning of coal produces $SO_x$ and $NO_x$ which is extremely hazardous to the environment.

The burners used in conventional pulverized coal boilers are inefficient insofar as they use a lot of power, require expensive coal pulverization, necessitate the application of expensive wet scrubbers to reduce $SO_x$ emissions, and produce flue gases with undesirably high $NO_x$ levels. Furthermore, $NO_x$ levels are typically reduced via selective catalytic reduction by injecting ammonium or urea, but ammonia may occur and the additive solutions are expensive.

In an effort to overcome the above-mentioned disadvantages of conventional pulverized coal burners and to provide a more environmentally acceptable means for producing energy from coal, the present inventor has investigated the use of rotating fluid bed combustors as burners in coal fired boiler applications.

Early research on rotating fluid bed combustors is set forth in U.S. Pat. No. 4,039,272 (Elliott), which issued Aug. 2, 1977, and articles by C. I. Metcalfe and J. R. Howard, "Fluidisation and Gas Combustion in a Rotating Fluidised Bed", *Applied Energy,* Applied Science Publishers Ltd., Vol. 3, (1977), pp. 65–73, and J. Broughton and D. E. Elliott, "Heat Transfer and combustion in Centrifugal Fluidized Beds", *I. Chem. E. Symposium Series No.* 43, pp. 11-1 to 11-6.

All of the aforementioned rotary fluidized bed combustors are directed to combustion of coal in drums or combustor assemblies which rotate about their vertical axis so as to form, substantially vertical beds. U.S. Pat. No. 4,039,272 (Elliott) discloses an apparatus for carrying out a reaction in a fluidized bed comprising a rotatable drum with a circumferential wall which is permeable to gases. A bed of particles is supported on the circumferential wall of the rotating drum during operation and the reactants are fed into the bed. A fluidizing gas is passed through the circumferential wall of the drum. A receiver is provided to retain small particles carried from the bed by the fluidizing gas. The small particles are returned to the bed when operation ceases. A reservoir for discharging larger particles into the bed after operation has commenced may be provided.

The aforementioned references disclose only vertically disposed rotary fluid bed combustors.

U.S. Pat. No. 5,070,821 (Virr), which issued on Dec. 10, 1991, discloses a horizontally disposed rotary fluid bed combustor which discloses a rotatable drum having a circumferentially extending wall which is permeable to gases; a means for feeding a fluidizing gas through the wall into the drum; a bed of particles which, at least when the gasifier is in use, is supported on an internal face of the wall and is fluidized by the fluidizing gas; an outlet means for receiving a carbonaceous material from outside the gasifier and delivering the carbonaceous material to the drum; a means for introducing steam into the drum; a de-$NO_x$ tube having a mixing zone and a nitrogen fixing zone; a means for introducing secondary air disposed between the mixing zone and the nitrogen fixing zone; and a means for introducing tertiary air disposed between the de-$NO_x$ tube and a main boiler or furnace.

According to the Virr patent the drum, i.e., the rotating section of the combustor assembly, is rotated by a shaft and drive belt driven by a motor. The shaft includes a post, oil seals, inner shell, outer shell and bearings. The shaft is connected to a distributor plate of the rotatable housing. The coal and limestone are fed into the fluidized bed via a chute disposed within the open side of the rotating drum which faces the de-$NO_x$ tube.

All of the aforementioned rotary combustors have been hampered by the lack of a practical method of introducing the fuel and other services such as a pilot burner to the rotating bed inside the revolving drum. The conventional method for introducing coal and limestone into a rotating bed as described in U.S. Pat. No. 5,070,821 is to feed it through a chute disposed within the open side of the rotating drum, i.e., the side closest to the de-$NO_x$ tube. This arrangement wherein the fuel and limestone feeds are introduced at or near the open side of the rotating drum typically subjects the fuel to high temperatures and premature carburization. Unfortunately, rotating fluid bed gasifiers have provided a very difficult technical problem for the introduction of the fuel and limestone into a rotating drum without premature carburization or a general loss of fuel due to the fuel being carried away together with the gaseous stream. This is both inefficient and results in an increase in $SO_x$ and $NO_x$ levels in the downstream boiler due to the non-gasified or carburized fuel which exits the gasifier into the boiler.

The present inventor has designed a unique feed mechanism for introducing fuel and limestone into a rotating fluid bed gasifier which is capable of avoiding premature carburization of the fuel and the carrying away of the fuel together with the gaseous stream.

The present invention also provides many additional advantages which shall become apparent as described below.

SUMMARY OF THE INVENTION

A rotary fluid bed gasifier which comprises: a combustor assembly having a rotatable inner assembly and a stationary outer section, the rotatable inner assembly comprising a circumferentially extending wall which is permeable to gases and a rotatable wall perpendicularly disposed with respect to the circumferentially extending wall so as to form a gasification chamber therebetween, and the stationary outer assembly comprising a stationary housing or casing disposed about the rotatable inner assembly; a means for feeding a fluidizing gas through the circumferentially extending wall into the gasification chamber; a bed of particles which, at least when the gasifier is in use, is supported on an internal face of the circumferentially extending wall and is fluidized by the fluidizing gas; a means for feeding a carbonaceous material from outside the gasifier and delivering the carbonaceous material to the gasification chamber, the means for feeding the carbonaceous material to the gasification chamber being a stationary conduit which is centrally disposed within the rotatable wall such that the rotatable inner assembly rotates about the stationary conduit; a means for introducing steam into the gasification chamber; a de-$NO_x$ tube having a mixing zone and a nitrogen fixing zone; a means for introducing secondary air disposed between the mixing zone and a nitrogen fixing zone; and a means for introducing tertiary air disposed between the de-$NO_x$ tube and a main boiler or furnace.

This gasifier design also permits the feeding of limestone and steam to the gasification chamber via the stationary conduit. Similarly, a means for detecting the reaction conditions in the gasification chamber may also be disposed within the stationary conduit.

The means for rotating the rotatable inner assembly of the combustor assembly about the stationary conduit comprises: a drive means; a means for connecting the drive means and the rotatable inner assembly, wherein the connecting means is disposed about the stationary conduit and affixed to the rotatable inner assembly; and a bearing assembly disposed between the outer surface of that portion of the rotatable inner assembly which is disposed about the stationary conduit and the inner surface of that portion of the stationary outer assembly which is disposed about the stationary conduit.

Preferably a rotary sealing means is disposed between the rotatable inner assembly and the stationary outer section.

The combustor assembly of the gasifier may also comprise an insulation layer disposed between the rotatable wall and the gasification chamber. This insulation layer preferably has a conical shape such that the center portion of the insulation layer is recessed in relation to that portion of the insulation layer in contact with the bed of particles. The recessed center portion of the insulation layer is disposed about the exit port of the stationary conduit.

It is also preferable that the gasifier be positioned horizontally such that the rotatable inner assembly of the combustor assembly rotates about its horizontal axis causing a horizontally sloping particle bed within the gasification chamber.

Optionally, a partition wall or weir may be disposed opposite the rotatable wall and about the circumferentially extending wall such that excess particles from the bed of particles are capable of spilling over the partition wall into a centrifuge section which is disposed between the gasification chamber and the de-$NO_x$ tube. A means for oxidizing the excess particles may optionally be attached to the centrifuge section, whereby the calcium sulfide contained within the excess particles is converted to calcium sulfate.

The present invention also includes a system for producing steam from the combustion of a carbonaceous material which comprises: a rotary fluid bed gasifier as discussed above; a main boiler, wherein a means for introducing tertiary air is disposed between the de-$NO_x$ tube and the main boiler; a superheater; an economizer; a baghouse; and a stack.

Other and further objects, advantages and features of the present invention will be understood by reference to the following specification in conjunction with the annexed drawings, wherein like parts have been given like numbers.

DESCRIPTION OF THE PREFERRED EMBODIMENTS

The rotary fluid bed gasifier is a shallow fluid bed which is supported on the circumference of a rotary drum (i.e., rotatable inner assembly) which holds the bed in position. This results in the ability to achieve high 'g' forces in the bed which in turn makes possible the use of higher velocities than are possible with 1 'g' beds. In this manner a gasifier may be operated at velocities up to 20 ft/sec. at combustion intensities of $3.2\times10^6$ Btu/ft$^3$/hr at atmospheric pressure. However, the rotary fluid bed gasifier of the present invention is operated at about one quarter to one half of this as it is only required to produce low Btu gas. The gasifier is fueled with a carbonaceous material, such as light gas oil, gas, coal, coal/water slurries, or bitumen/water slurry mixture.

Figure 1:
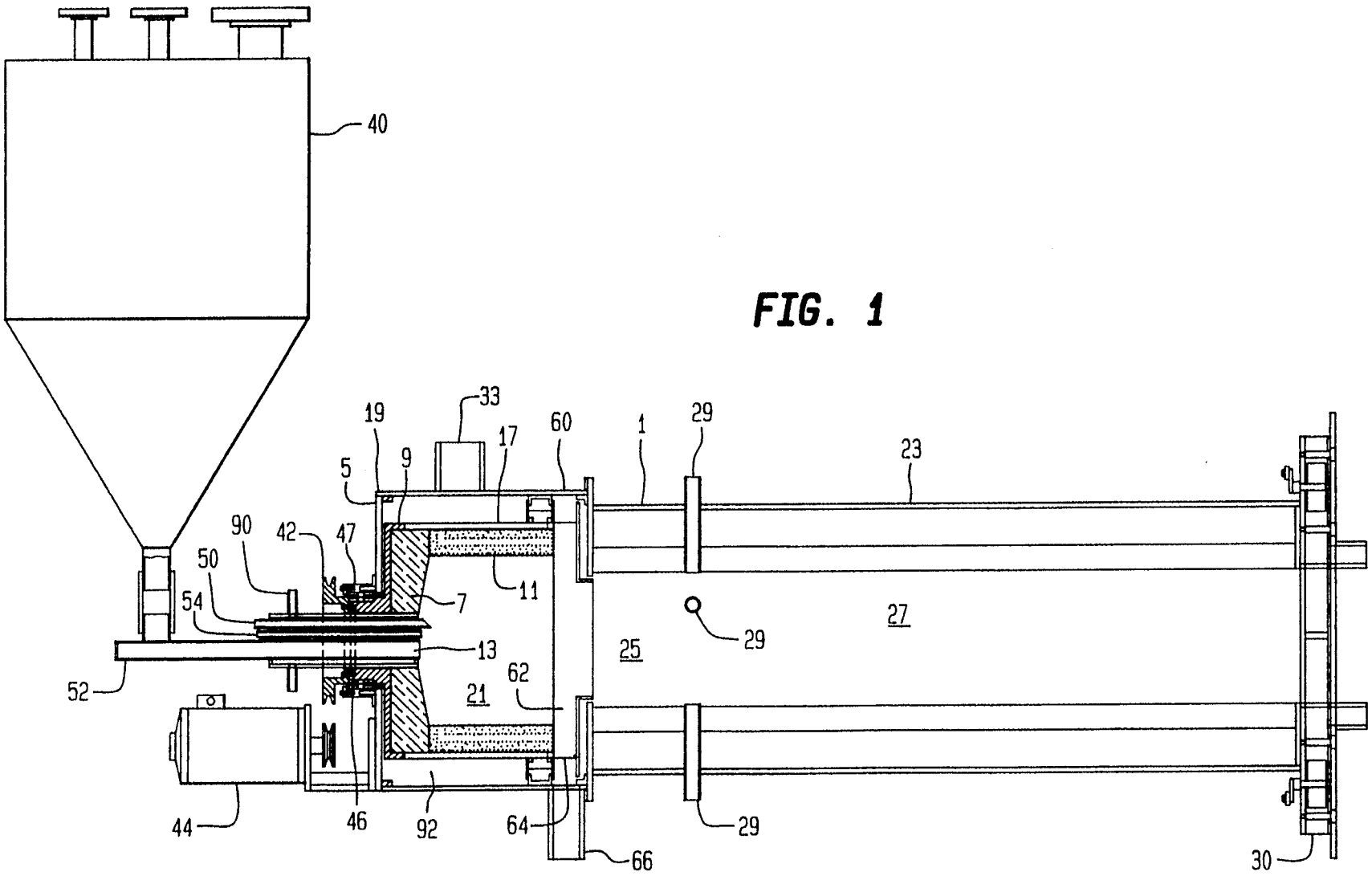
FIG. 1 is a schematic representation illustrating a rotary fluid bed gasifier with a stationary center feed conduit or tube in accordance with the present invention.
Figure 3:
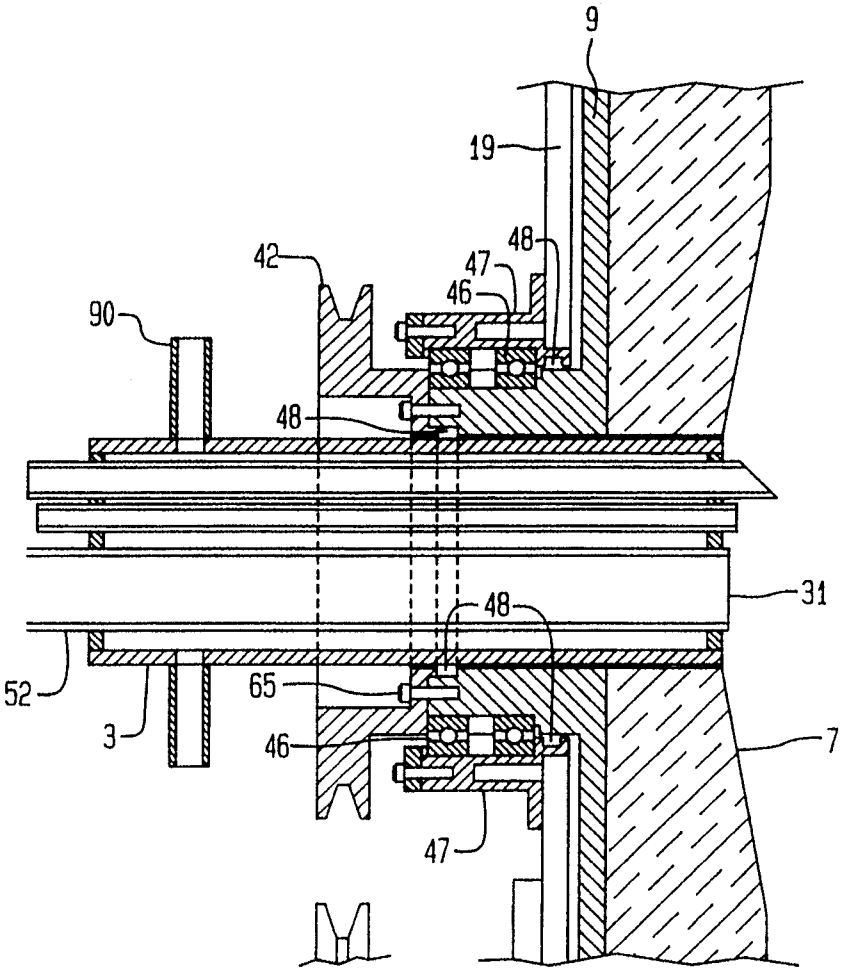
FIG. 3 is a schematic representation illustrating the bearing assemblies and gas seals about the stationary center feed conduit of the present invention.

The present invention can best be described by referring to the attached drawings, wherein FIGS. 1 and 3 provide a schematic representation of the novel rotary fluid bed gasifier 1 having a stationary center feed conduit 3 which is capable encasing a feed shaft 52, a pilot light 50, a steam conduit 54 and any other instrumentation devices necessary for monitoring the reaction conditions of the gasification process. Rotary gasifier 1 has a novel configuration which is capable of feeding fuel and limestone to combustor assembly 5 in such a manner that premature carburization of the fuel is avoided. Also insulation layer 7, which is disposed between rotatable wall or backplate 9 and fluid bed 11, has a conical shape wherein fuel or feed entry port 13 is recessed back from fluid bed 11 such that the fuel and/or limestone is guided down the surface of insulation layer 7 into fluid bed 11. In this way the carrying away of the fuel and/or limestone together with the gasified gas stream is substantially avoided. That is, a majority of the fuel and/or limestone enters combustor assembly 5 via port 13 and due the centrifugal forces created within combustor assembly 5 by the rotation of the rotatable inner assembly or drum (i.e., rotatable wall 9 and circumferentially extending wall 17) thereof the fuel and/or limestone is forced against the sidewall of insulation layer 7 until is reaches fluid bed 11 where it is consumed and gasified.

Figure 2:
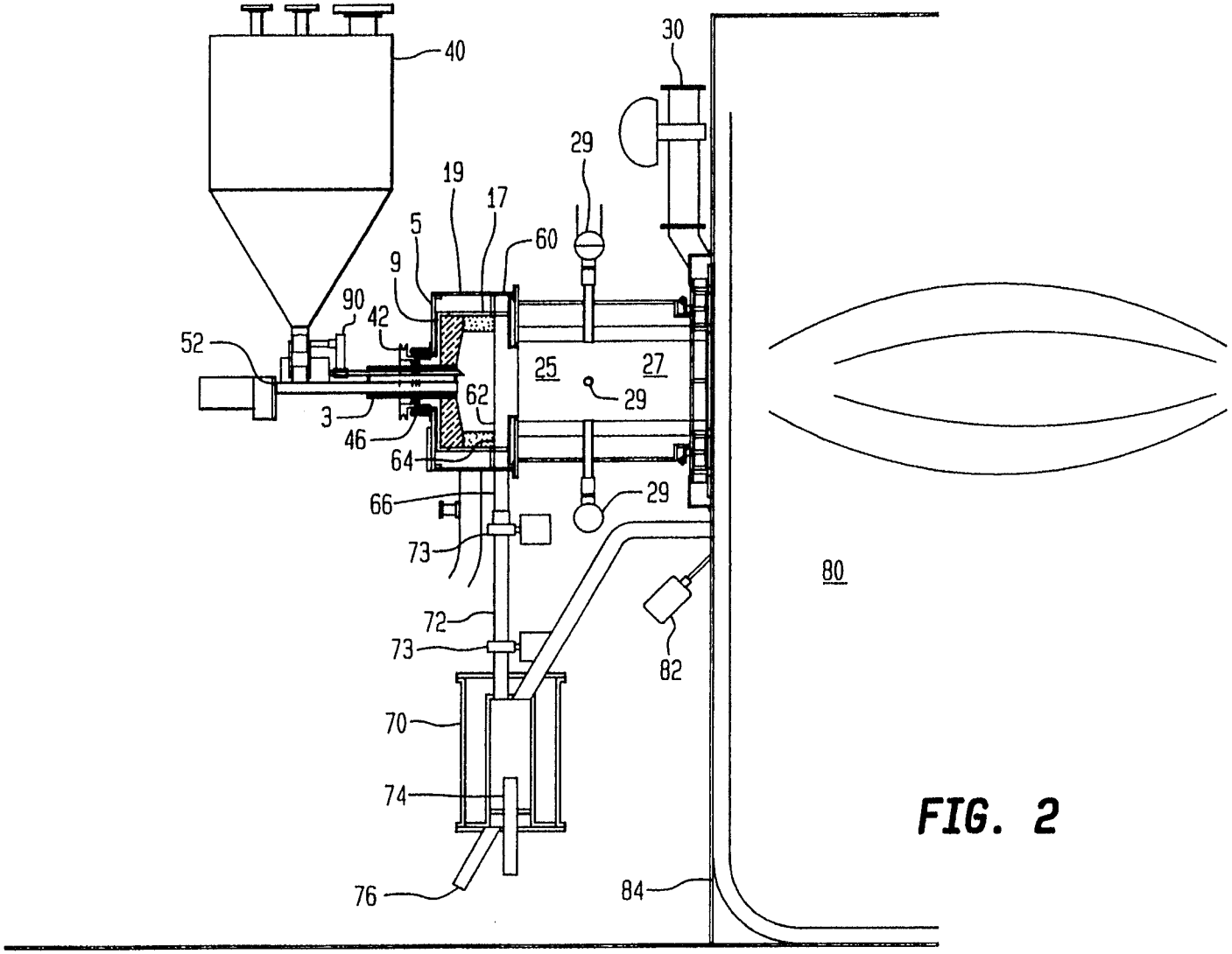
FIG. 2 is a schematic representation illustrating a rotary fluid bed gasifier having an oxidizer section in accordance with another embodiment of the present invention.

Rotary fluid bed gasifier 1 is typically affixed to the wall 84 of utility boiler 80 as shown in FIG. 2. Gasifier 1 comprises a combustor assembly 5 having a rotatable inner assembly or drum and a stationary outer section.

The rotatable inner assembly comprises a rotatable wall 9, circumferentially extending wall 17 which is permeable to gases, and, optionally, insulation layer 7. The stationary outer assembly comprises a stationary housing or casing 19. A conduit means 33 is disposed within stationary housing 19 in order to feed a primary fluidizing gas (e.g., air) and/or a combustible gas through wall 17 into gasification chamber 21. A bed of particles 11 which, at least when gasifier 1 is in use, is supported on gas permeable wall 17 (i.e., a distribution plate) and is fluidized by the fluidizing gas introduced via conduit means 33. Each gasifier 1 is equipped with a stationary hollow conduit or tube 3 which is capable of delivering fuel, limestone, water, steam, a pilot light and instrumentation devices to gasification chamber 21. Optionally, gasifier 1 may be provided with a de-$NO_x$ tube 23 having a mixing zone 25 and a nitrogen fixing zone 27, a means 29 for introducing secondary air disposed between mixing zone 25 and nitrogen fixing zone 27, and a means 30 for introducing tertiary air disposed between de-$NO_x$ tube 23 and main boiler or furnace 31.

Gasifier 1 may also be modified to include a means for introducing steam into combustor assembly 5. The steam together with a fluidizing gas comprising approximately 10–60% stoichiometric air produces a reducing condition in gasification chamber 21.

Gasifier 1 is positioned horizontally such that the rotatable inner assembly of combustor assembly 5 rotates about its horizontal axis causing a horizontally sloping particle bed 11 within gasification chamber 21.

Combustor assembly 5 is disposed about stationary conduit 3 in such a way that fuel and/or limestone from hopper 40 is screw fed via feed shaft 52 which is disposed within stationary conduit 3 into gasification chamber 21. The rotatable inner assembly of combustor assembly 5 is rotated about stationary conduit 3 by means of a pulley 42 which is connected to a drive motor 44 by any conventional belt (not shown). Pulley 42 is attached to the rotatable inner assembly of combustor assembly 5 by means of bolts 65 which are secured to rotatable wall or backplate 9. Rotatable wall 9 rotates about stationary conduit 3 by means of bearings 46 mounted in a boss 47 which forms part of stationary housing 19. Bearings 46 are disposed between stationary housing 19 and backplate 9 in such a manner that the rotatable inner assembly revolves around stationary conduit 3 while stationary housing 19 remains stationary with respect to the rotatable inner assembly. The primary fluidizing air which is supplied to combustor assembly 5 via conduit 33 must be held at pressure within stationary housing 19 in order to supply air to fluid bed 11 through the gas permeable circumferentially extending wall 17. This is achieved by placing rotary seals 48 between the inside surface of stationary housing 19 and the outside surface of rotatable wall 9, as well as between the inside surface of rotatable wall 9 and the outside surface of stationary conduit 3.

A solid carbonaceous fuel is typically introduced through a screw disposed within shaft 52, but a simple pipe with a nozzle on the end will suffice when a liquid fuel in used.

A pilot light 50 may also be introduced into gasification chamber 21 via stationary conduit 3. Stationary conduit 3 may also house and introduce other services to gasification chamber 21, such as the limestone feed for sulfur retention, instrumentation such as temperature measurement devices (e.g., thermocouples) and water or steam for control and gasification requirements.

Optionally, stationary conduit 3 may be cooled by the introduction of a cooling fluid, e.g., water, into conduit 90 which encapsulates stationary conduit 3.

The fluid bed gasification zone or chamber 21 is preferably followed by a centrifuge section 60. In centrifuge section 60 the rapidly revolving solid particles from fluid bed 11 are allowed to spill over partition wall or weir 62 which is disposed at the end of fluid bed 11 closest to the open side of combustor assembly 5. The solid particles are then centrifuged out through pierced cage 64 and fall by gravity into ash outlet 66. As shown in FIG. 2, the solid particles or ash which are centrifuged out to ash outlet 66 contains calcium sulfide which drops into an oxidizer unit 70.

Oxidizer 70 is arranged directly beneath ash outlet 66 and attached by pipe 72 to combustor assembly 5. The ash flows through two ash valves 73, which operate in such a fashion where ash is allowed to pass therethrough without any gasified gas reaching oxidizer 70. Oxidizer 70 contains a fluid bed 74 which is fluidized with oxidizing air supplied via air inlet conduit 76. This air converts the calcium sulfide to calcium sulfate which is acceptable for disposal to landfill or other environmentally accepted means. Oxidizer 70 is connected to a flue 78 which allows the combustion gases to pass back to boiler or furnace 80 into which the rotary gasifier is firing. Optionally, a flame detector 82 is affixed to sidewall 84 of boiler or furnace 80 in order to determine the presence of a stable flame.

The present invention also includes a method of producing steam from the combustion of a carbonaceous material in rotary fluid bed gasifier 1 which comprises the steps of: introducing a fluidizing gas and a combustible gas via conduit 33 and stationary conduit or tube 3 into combustor assembly 5 wherein bed particles, e.g., sand, are fluidized to form fluid bed 11; igniting the combustible gas within gasification chamber 21 by light-up or pilot light burner 50 which may also be introduced via stationary conduit 3; heating the bed particles to approximately 1000° F. (538° C.); introducing a carbonaceous material and/or limestone from hopper 40 to gasification chamber 21 via feed conduit or screw 52 which is enclosed within stationary conduit 3; removing combustible gas by shutting off its supply via conduit 33; introducing steam into gasification chamber 21 via steam conduit 54 which may also be disposed within stationary conduit 3; controlling the temperature within gasification chamber 21 to between about 1600°–1800° F. (871°–982° C.) by adjusting the flow rate of the fluidizing gas and the steam, the speed of the rotatable inner assembly of combustor assembly 5, and the rate of introduction of carbonaceous material; and introducing secondary air via air nozzles 29 and tertiary air via conduit 30. The fluidizing gas is preferably fed into combustor assembly 5 at a rate lower than that necessary to provide for complete combustion of the carbonaceous material so as to produce a low Btu gas.

Combustor assembly 5 comprises a rotatable inner assembly and a stationary outer section. The rotatable inner assembly of combustor assembly 5 comprises rotatable wall 9, circumferentially extending wall 17 and, optionally, insulating layer 7. The stationary outer assembly comprises a stationary housing or casing 19 which is disposed such that a plenum chamber 92 is formed between the inner Surface of housing 19 and the outer surface of wall 17. Chamber 92 permits fluidizing gas from conduit 33 to enter housing 19 and thereafter pass into gasification chamber 21 via circumferentially extending wall 17. The rotatable inner assembly of combustor assembly 5 is rotatably disposed between stationary housing 19 and de-$NO_x$ tube 27 both of which remain stationary during normal operation. The rotatable inner assembly of combustor assembly 5 preferably rotates at a speed in the range between about 50 rpm to about 1000 rpm.

Coal, oil, coal/water slurries, bitumen/water slurry mixtures or the like are continuously fed through stationary conduit 3 via screw or tube 52 into gasification chamber 21 subsequent to starting up gasifier 1. The coal feed enters gasification chamber 21 via port 13 in stationary conduit 3 and traverses along the recessed wall of insulation layer 7 until it reaches fluid bed 11. Preferably, limestone and steam may also be introduced to gasification chamber 21 via stationary conduit 3. During normal operation, gasification chamber 21 is maintained at a temperature of approximately 1600–1800° F. (871°–982° C.) which provides a reducing environment and generates a hot low Btu gas, i.e., 100–160 Btu/$ft^3$. The resultant gas exits chamber 21 and enters mixing zone 25 of de-$NO_x$ tube 23 where the temperature of the gas is raised. Secondary air is injected into de-$NO_x$ tube 23 via secondary air nozzles 29 and raises the temperature to 2800°–3200° F. (1538°–1760° C.). Secondary air reacts with the gas in nitrogen fixing zone 27 in accordance with the below equation:

$$4\ NH_3+3O_2+N_2 \rightarrow 6H_2O+3N_2$$

Thus, the increase in temperature dissociates the ammonia and any hydrogen cyanide to water vapor and nitrogen.

The low Btu gas has a temperature after passing through nitrogen fixing zone 27 of approximately 2800°–3200° F. (1538°–1760° C.). The nitrogen fixed low Btu gas is then contacted with a tertiary air or final combustion air from conduit 30 to cause complete combustion of the low Btu gas emitted from gasifier 1. Since some coal ash particles escape from gasifier 1 into the attached boiler or furnace, the resultant flame is luminous. This flame has a temperature of approximately 2200°–3000° F. (1204°–1650° C.).

Figure 4:
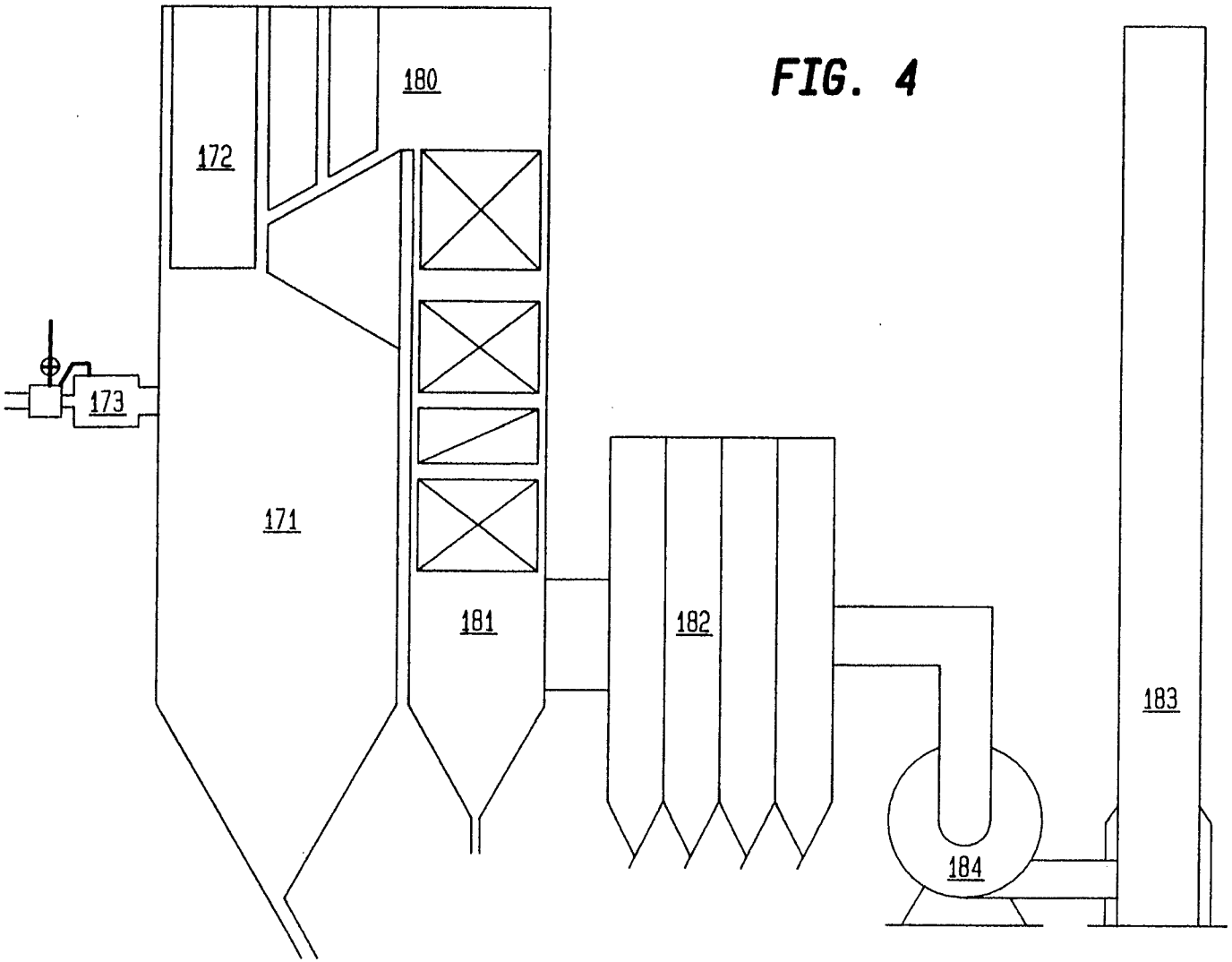
FIG. 4 is a schematic representation illustrating the application of the rotary fluid bed gasifier of the present invention in a conventional boiler system.

The rotary fluid bed gasifier is typically mounted onto a conventional pulverized coal boiler. FIG. 4 is a pulverized coal boiler system having a boiler with combustion chamber 171. The heat generated from the flame of gasifier 173 produces steam in heat exchange means disposed within the boiler. The flue gas exits combustion chamber 171 via platens 172 and superheater 180. Thereafter, the flue gas passes through economizer 181 and baghouse 182, and is directed from baghouse 182 to stack 183 via blower 184. The flue gas which is emitted to the atmosphere via stack 183 typically has $SO_x$ of less than 10% and $NO_x$ of less than 100 ppm, and maybe as low as 25 ppm.

It is proposed that the rotary fluid bed gasifier of the present invention be installed or retrofitted to conventional 50–660 megawatt pulverized coal boilers in place of conventional burners. This gasifier may also be attached to a reverberating furnace for metal melting or heat treatment. The gasifier may also be used as a gas turbine when the hot gas is filtered with optional clean-up equipment.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A rotary fluid bed gasifier which comprises:

a combustor assembly which comprises a rotatable inner assembly and a stationary outer assembly, said rotatable inner assembly comprising a circumferentially extending wall which is permeable to gases and a rotatable wall perpendicularly disposed with respect to said circumferentially extending wall so as to form a gasification chamber therebetween, and said stationary outer assembly comprises a stationary housing disposed about said rotatable inner assembly;

a means for feeding a fluidizing gas through said circumferentially extending wall into said gasification chamber;

a bed of particles which, at least when said gasifier is in use, is supported on an internal face of said circumferentially extending wall and is fluidized by said fluidizing gas; and a means for feeding a carbonaceous material from outside said gasifier and delivering said carbonaceous material to said gasification chamber, said means for feeding said carbonaceous material to said gasification chamber being a stationary conduit which is centrally disposed within said rotatable wall such that said rotatable inner assembly is capable of rotating about said stationary conduit.

2. The gasifier according to claim 1 wherein said gasifier includes a means for feeding limestone from outside said gasifier and delivering said limestone to said gasification chamber, said means for feeding said limestone being said stationary conduit.

3. The gasifier according to claim 1 wherein said gasifier includes a means for introducing steam or water from outside said gasifier and delivering said steam or water to said gasification chamber, said means for introducing said steam or water being said stationary conduit.

4. The gasifier according to claim 1 wherein said gasifier includes a means for detecting the reaction conditions in said gasification chamber which is disposed within said stationary conduit.

5. The gasifier according to claim 1 wherein said rotatable inner assembly further comprises an insulation layer disposed between said rotatable wall and said gasification chamber.

6. The gasifier according to claim 1 wherein said insulation layer has a conical shape such that the center portion of said insulation layer is recessed in relation to that portion of said insulation layer in contact with said bed of particles.

7. The gasifier according to claim 1 wherein the recessed center portion of said insulation layer is disposed about an outlet port of said stationary conduit.

8. The gasifier according to claim 1 wherein said gasifier is positioned horizontally such that said rotatable inner assembly of said combustor assembly rotates about its horizontal axis causing a horizontally sloping particle bed within said gasification chamber.

9. The gasifier according to claim 1 further comprising a partition wall disposed about said circumferentially extending wall such that excess particles from said bed of particles are capable of spilling over said partition wall into a centrifuge section.

10. The gasifier according to claim 9 further comprising a means for oxidizing said excess particles from said centrifuge section, whereby the calcium sulfide contained within said excess particles is converted to calcium sulfate.

11. The gasifier according to claim 1 further comprising a means for rotating said rotatable inner assembly of said combustor assembly about said stationary conduit which comprises:

a drive means;

a means for connecting said drive means and said rotatable inner assembly, wherein said connecting means is disposed about said stationary conduit and affixed to said rotatable inner assembly; and a bearing assembly disposed between the outer surface of that portion of said rotatable inner assembly which is disposed about said stationary conduit and the inner surface of that portion of said stationary outer assembly which is disposed about said stationary conduit.

12. The gasifier according to claim 11 which comprises a sealing means disposed between said rotatable inner assembly and said stationary outer assembly.

13. The gasifier according to claim 1 further comprising:

a means for introducing steam or water into said gasification chamber;

a de-$NO_x$ tube having a mixing zone and a nitrogen fixing zone;

a means for introducing secondary air disposed between said mixing zone and a nitrogen fixing zone; and a means for introducing tertiary air disposed between said de-$NO_x$ tube and a main boiler or furnace.

14. A system for producing steam from the combustion of a carbonaceous material which comprises:

a rotary fluid bed gasifier which comprises: a combustor assembly which comprises a rotatable inner assembly and a stationary outer assembly, said rotatable inner assembly comprises a circumferentially extending wall which is permeable to gases and a rotatable wall perpendicularly disposed with respect to said circumferentially extending wall so as to form a gasification chamber therein, and said stationary outer assembly comprises a stationary housing disposed about said rotatable inner assembly; a means for feeding a fluidizing gas through said circumferentially extending wall into said gasification chamber; a bed of particles which, at least when said gasifier is in use, is supported on an internal face of said circumferentially extending wall and is fluidized by said fluidizing gas; and a means for feeding a carbonaceous material from outside said gasifier and delivering said carbonaceous material to said gasification chamber, said means for feeding said carbonaceous material to said gasification chamber being a stationary conduit which is centrally disposed within said rotatable wall such that said rotatable inner assembly is capable of rotating about said stationary conduit;

a main boiler;

a superheater;

an economizer;

a baghouse; and a stack.

15. The system according to claim 14 wherein said gasifier includes a means for feeding limestone from outside said gasifier and delivering said limestone to said gasification chamber, said means for feeding said limestone being said stationary conduit.

16. The system according to claim 14 wherein said gasifier includes a means for introducing steam from outside said gasifier and delivering said steam to said gasification chamber, said means for introducing said steam being said stationary conduit.

17. The system according to claim 14 wherein said gasifier includes a means for detecting the reaction conditions in said gasification chamber which is disposed within said stationary conduit.

18. The system according to claim 14 wherein said rotatable inner assembly further comprises an insulation layer disposed between said rotatable wall and said gasification chamber.

19. The system according to claim 14 wherein said insulation layer has a conical shape such that the center portion of said insulation layer is recessed in relation to that portion of said insulation layer in contact with said bed of particles.

20. The system according to claim 14 wherein the recessed center portion of said insulation layer is disposed about the exit port of said stationary conduit.

21. The system according to claim 14 wherein said gasifier is positioned horizontally such that said rotatable inner assembly of said combustor assembly rotates about its horizontal axis causing a horizontally sloping particle bed within said gasification chamber.

22. The system according to claim 14 further comprising a partition wall disposed about said circumferentially extending wall such that excess particles from said bed of particles are capable of spilling over said partition wall into a centrifuge section.

23. The system according to claim 22 further comprising a means for oxidizing said excess particles from said centrifuge section, whereby the calcium sulfide contained within said excess particles is converted to calcium sulfate.

24. The system according to claim 23 further comprising a means for delivering combustion gases contained within said excess particles to said main boiler.

25. The system according to claim 14 further comprising a means for rotating said rotatable inner assembly of said combustor assembly about said stationary conduit which comprises:

a drive means;

a means for connecting said drive means and said rotatable inner assembly, wherein said connecting means is disposed about said stationary conduit and affixed to said rotatable inner assembly; and a bearing assembly disposed between the outer surface of that portion of said rotatable inner assembly which is disposed about said stationary conduit and the inner surface of that portion of said stationary outer assembly which is disposed about said stationary conduit.

26. The system according to claim 25 which comprises a sealing means disposed between said rotatable inner assembly and said stationary outer assembly.

27. The gasifier according to claim 14 further comprising:

a means for introducing steam or water into said gasification chamber;

a de-$NO_x$ tube having a mixing zone and a nitrogen fixing zone;

a means for introducing secondary air disposed between said mixing zone and a nitrogen fixing zone; and a means for introducing tertiary air disposed between said de-$NO_x$ tube and a main boiler or furnace.

* * * * *